US009002256B2

(12) United States Patent
Tooker et al.

(10) Patent No.: US 9,002,256 B2
(45) Date of Patent: Apr. 7, 2015

(54) ADAPTIVE SCHEDULER THAT CORRECTS FOR PAPER PROCESS DIRECTIONAL ARRIVAL ERRORS TO PRINT ENGINE REGISTRATION SUBSYSTEM

(75) Inventors: Ana Perez Tooker, Penfield, NY (US); Ronald W. Bogert, Webster, NY (US); David M. Kerxhalli, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 1079 days.

(21) Appl. No.: 12/578,734

(22) Filed: Oct. 14, 2009

(65) Prior Publication Data

US 2011/0084438 A1 Apr. 14, 2011

(51) Int. Cl.

| | |
|---|---|
| ***G03G 15/00*** | (2006.01) |
| ***B65H 7/02*** | (2006.01) |
| ***B65H 43/00*** | (2006.01) |
| *G03G 15/23* | (2006.01) |

(52) U.S. Cl.

CPC ..... *B65H 7/02* (2013.01); *B65H 43/00* (2013.01); *G03G 15/6564* (2013.01); *B65H 2301/331* (2013.01); *B65H 2513/50* (2013.01); *B65H 2513/53* (2013.01); *B65H 2557/2423* (2013.01); *B65H 2601/12* (2013.01); *G03G 15/235* (2013.01)

(58) Field of Classification Search

CPC ..... G03G 15/00
USPC ..... 399/388, 394; 271/3.16, 226, 227, 228, 271/265.03

See application file for complete search history.

(56) References Cited

U.S. PATENT DOCUMENTS

| | | | | |
|---|---|---|---|---|
| 4,956,651 | A * | 9/1990 | Emori | 347/264 |
| 5,528,347 | A * | 6/1996 | Kamath et al. | 399/18 |
| 6,014,542 | A * | 1/2000 | Hozumi et al. | 399/394 |
| 6,324,377 | B2 * | 11/2001 | Ando et al. | 399/395 |
| 6,370,354 | B1 * | 4/2002 | Chapman et al. | 399/394 |
| 6,400,912 | B1 * | 6/2002 | Tanaka et al. | 399/45 |
| 8,355,159 | B2 * | 1/2013 | Dobbertin et al. | 358/1.4 |
| 2004/0047661 | A1 * | 3/2004 | Weinlich et al. | 399/381 |
| 2005/0254870 | A1 * | 11/2005 | Takahashi | 399/388 |
| 2006/0051145 | A1 * | 3/2006 | Ubayashi | 399/395 |
| 2006/0239733 | A1 * | 10/2006 | Choi et al. | 399/396 |
| 2007/0248365 | A1 * | 10/2007 | Gettelfinger et al. | 399/16 |
| 2008/0285988 | A1 * | 11/2008 | Uchida et al. | 399/43 |

FOREIGN PATENT DOCUMENTS

| | | | | |
|---|---|---|---|---|
| JP | 2001206583 | A * | 7/2001 | G03G 15/00 |

* cited by examiner

*Primary Examiner* — Nguyen Ha
(74) *Attorney, Agent, or Firm* — Fay Sharpe LLP

(57) ABSTRACT

Systems and methods are described that facilitate correcting for paper process direction arrival errors during a print job in a marker module of a print engine. Paper sheet arrival time is determined at a first registration point in a print engine or marker module thereof, and an average arrival time is compared to an expected arrival time to determine whether the pages are arriving on time, early, or late. The arrival time error is used to generate or look up a correction factor, which is added to an expected arrival time at a second registration point in the marker module or print engine to generate an updated expected arrival time. Print engine control parameters (e.g., sheet feeder timing, toner application, paper path speed, etc.) are adjusted according to the updated expected arrival time at the second registration point.

20 Claims, 4 Drawing Sheets

ADAPTIVE SCHEDULER THAT CORRECTS FOR PAPER PROCESS DIRECTIONAL ARRIVAL ERRORS TO PRINT ENGINE REGISTRATION SUBSYSTEM

BACKGROUND

The subject application relates to paper process directional control systems and methods. While the systems and methods described herein relate to correcting for directional arrival errors in a print engine and the like, it will be appreciated that the described techniques may find application in other process control systems, other xerographic applications, and/or other process control methods.

Classical registration systems for print engines register sheets as they enter from a feeder. Such systems can only correct for errors detected for sheets that register within a given time window.

Known registration subsystems for print systems correct for lateral, skew, and process direction errors for a limited input error range. However, the arrival process direction errors can exceed the input range limit due to a variety of system factors, including the number of feeder modules in the system, 3$^{rd}$ party feeding devices, media type, part wear, etc. In classical systems, all scheduled feed and duplex eject times are at fixed delta times. Thus, if one or more sheets arrive outside of the correctable registration window, an image-to-paper registration defect occurs.

Accordingly, there is an unmet need for systems and/or methods that facilitate adjusting an expected arrival time using feedback, and to permit a registration subsystem to deliver the sheet to transfer more accurately, and the like, while overcoming the aforementioned deficiencies.

BRIEF DESCRIPTION

In accordance with various aspects described herein, systems and methods are described that facilitate correcting for paper process directional arrival errors in a print engine. For example, a method of correcting for paper process direction arrival errors during a print job in a print engine comprises detecting paper sheet arrival times at a first registration point in the print engine over a predetermined time period, calculating a running average of the detected arrival times, and comparing the average arrival time to an expected sheet arrival time for the first registration point. The method further comprises determining a registration correction factor as a function of a difference between the average arrival time to an expected sheet arrival time for the first registration point, and adding the correction factor to an expected arrival time for a second registration point to generate an updated expected arrival time value for the second registration point. Additionally, the method comprises adjusting control parameters of a marking module in the print engine according to the updated expected arrival time value.

According to another feature described herein, a system that facilitates correcting for paper process direction arrival errors during a print job comprises a marker module that generates printed paper sheets, a registration subsystem comprising a plurality of sensors that detect and register sheets at one or more points along a paper path, and a scheduler that controls the marking module to apply toner to the sheets. The scheduler comprises a processor that receives sensed sheet arrival times at a first registration point on the paper path over a predetermined time period, calculates a running average of the sensed arrival times, and compares the average arrival time to an expected sheet arrival time for the first registration point. The processer furthermore determines a registration correction factor as a function of a difference between the average arrival time to an expected sheet arrival time for the first registration point, adds the correction factor to an expected arrival time for a second registration point to generate an updated expected arrival time value for the second registration point, and adjusts control parameters of a marking module in the print engine according to the updated expected arrival time value.

Yet another feature relates to a method of correcting for paper process direction arrival errors during a print job in a marker module of a print engine comprises determining an average arrival time for a plurality of paper sheets at a first registration point on a paper path traversed by the sheets, determining a registration error value by comparing the average arrival time to an expected arrival time at the first registration point, and determining a correction factor for the registration error. The method further comprises adding the correction factor to an expected arrival time at a second registration point on the paper path to generate a corrected expected arrival time at the second registration point, and adjusting control of the marker module according to the corrected expected arrival time.

DETAILED DESCRIPTION

In accordance with various features described herein, systems and methods are described that overcome the above-described problems by using feedback from a registration subsystem to adjust the scheduled time of sheet arrival from a feeder to a print engine or marker entrance, and/or sheet eject from a duplex inverter, to optimize for registration performance and compensate for accumulated system process timing errors. The systems and methods described herein facilitate adjusting the scheduled times for simplex (single-sided) printed (e.g., where a leading edge of a sheet registers at the print engine entrance/feeder exit docking plane) and duplex (dual-sided) printed (e.g., leading edge eject time) sheets using an error calculated at a registration entrance sensor. For instance, an algorithm is executed to calculate a running average of the error at registration entrance, and to adjust the scheduled time (e.g., expected arrival time) accordingly to reduce the error at registration.

Figure 1:
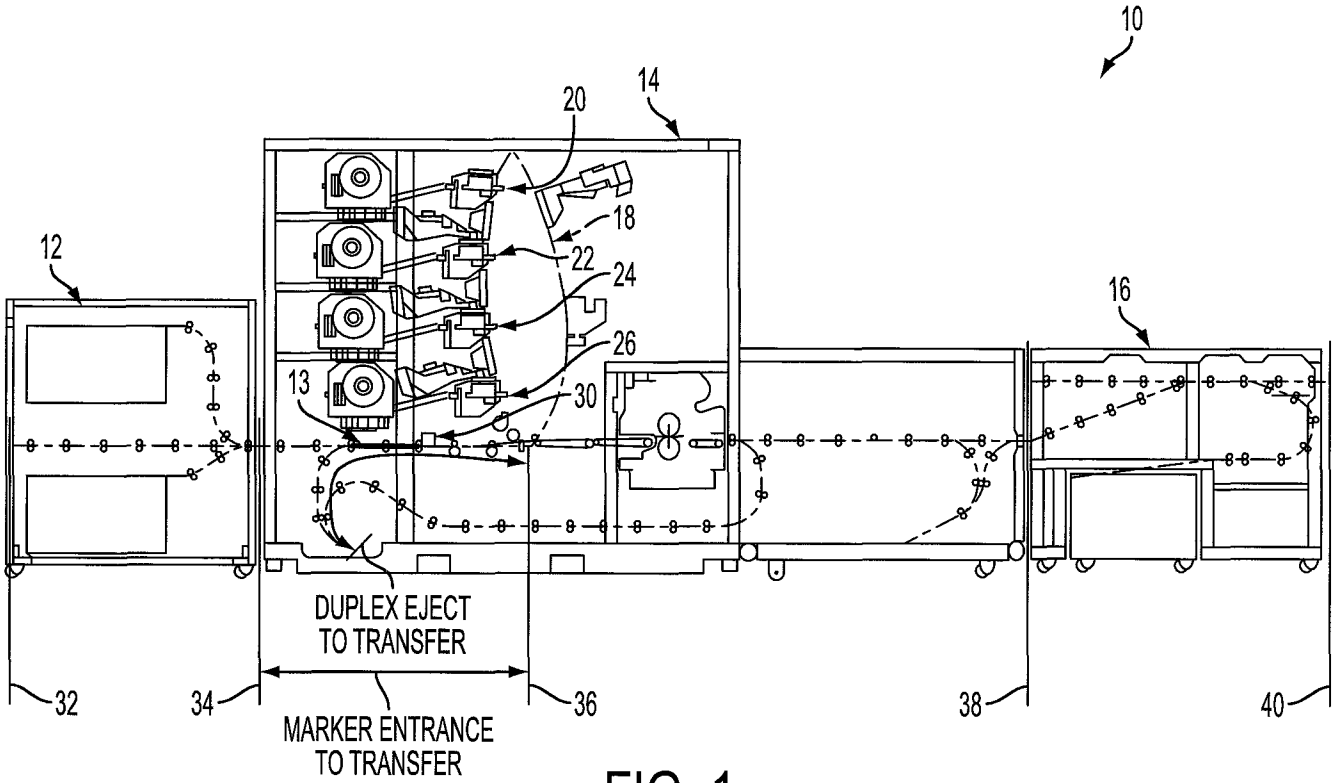
FIG. 1 illustrates a printing system that facilitates using adaptive learning algorithms and feedback information to adjust sheet registration times.

With reference to FIG. 1, a printing system 10 that facilitates using adaptive learning algorithms and feedback information to adjust sheet registration times. The system 10 includes a feeder module 12 that feeds sheets 13 (e.g., paper or other print media) into a marker module 14, which outputs printed sheets to a stacker module 16. The marker module 14 includes a photoreceptor 18 and a plurality of image transfer rollers or nips that transfer a toner image to the photoreceptor for transfer to the sheets 13 as the sheets pass by each respective image transfer roller located at an image transfer position 36. According to an example, the marker module 14 includes a magenta roller 20, a yellow roller 22, a cyan roller 24, and a key (e.g., black) roller 26 to from toner images on the photoreceptor 18. However, it will be appreciated that the described systems and methods are not limited to CYMK marking techniques, by rather may use any suitable monochrome or color marking technique (e.g., red, green, blue, white (RGBW) marking techniques, or the like).

As the key (black) roller 26 begins to lay down toner on a leading edge of a given sheet image on the photoreceptor (e.g., as the leading edge of the given image passes the key roller 26), a digital signal is generated and includes a timestamp or other information indicating a time of arrival of the leading edge of the given image for the given sheet 13. Since the speed at which the image is traveling on the PR belt 18 is known, and since the distance between imaging stations (e.g., between rollers) is known, the system knows when to begin writing with each respective imaging station. In other words, the expected time at which the image for the given page of the given sheet 13 arrives at the key roller 26 is determined as a function of the known entrance time of the given sheet 13, the distance between the registration entrance point and the sensor 30, which is positioned adjacent the key roller, and the speed at which the sheet 13 travels along the paper path. Additionally, the marker module 14 comprises a registration entrance sensor 30 that senses sheet position for adjusting a duplex "eject-to-transfer" time. If sheets are behind schedule when sensed by the sensor 30, then a scheduler (not shown) determines a correction factor for the sheets and adjusts a duplex eject time by adding the correction factor to a duplex eject-to-transfer time to compensate for arrival errors in the duplex path. In one example, the scheduling adjustment is a function of the difference between the expected arrival time of the leading edge of the page image at the key roller 26, as determined from the entrance registration time of the sheet 13, sheet speed, and distance from the entrance of the page to the sensor 30 adjacent the key roller 26, and the actual arrival time (as determined from the digital signal generated when the key roller 26 begins to apply toner at the leading edge of the sheet image on the photoreceptor).

For instance, the system 10 is illustrated with a plurality of scheduler reference locations or points 32, 34, 36, 38, 40 for the various modules. For Simplex sheets, the scheduler (not shown) adjusts a marker entrance/feeder exit reference time by adding a correction factor to the marker entrance-to-transfer scheduling time, to compensate for arrival errors from the feeder(s). This adjustment results in the feeders feeding at a different real-time (relative to each other) to meet the adjusted feeder exit time. The adjustment differs from modified feed techniques in that it does not adjust the feed offset nonvolatile memory (NVM) settings for each feeder tray. Rather, the described systems and methods can compensate for any feeder. This is especially useful for multiple feeder systems and 3$^{rd}$ party feeding configurations.

Figure 2:
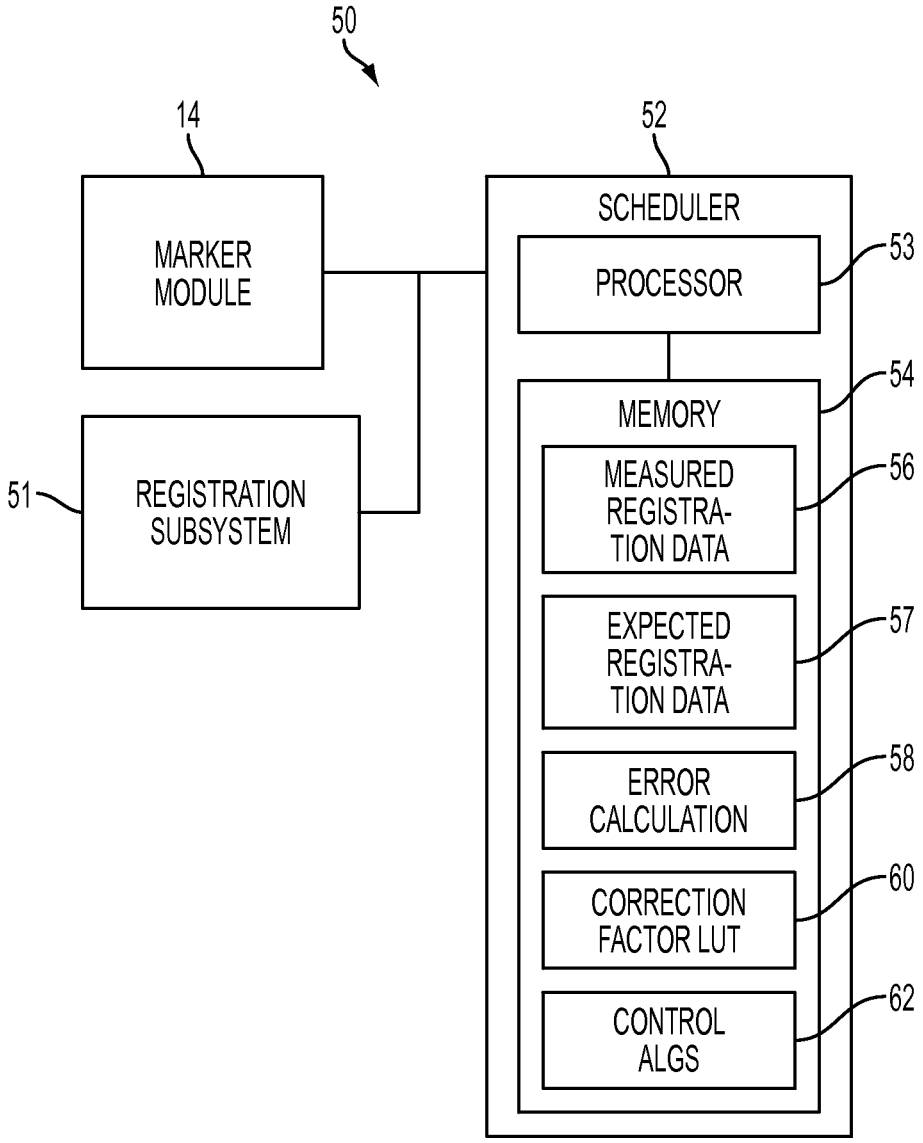
FIG. 2 illustrates marking system that includes the marker module, which is coupled to a registration subsystem and a scheduler.

FIG. 2 illustrates marking system 50 that includes the marker module 14, which is coupled to a registration subsystem 51 and a scheduler 52. It will be appreciated that the registration subsystem 51 and scheduler 52 may be separate from the marker module, as illustrated, or may be integral thereto. The registration subsystem comprises a plurality of sensors (see, e.g., FIG. 1) that sense or detect paper sheets at various points along a paper path through the print engine. The scheduler 52 comprises a processor 53 that executes, and memory 54 that stores, computer-executable instructions and/or computer-readable data for performing the various techniques and/or methods described herein. The memory 54 may be a computer-readable recording medium on which a control program is recorded, such as a disk, hard drive, or the like. Common forms of computer-readable media include, for example, floppy disks, flexible disks, hard disks, magnetic tape, or any other magnetic storage medium, CD-ROM, DVD, or any other optical medium, a ROM, a PROM, an EPROM, a FLASH-EPROM, or other memory chip or cartridge, or any other tangible medium from which a computer can read and use. Alternatively, the method may be implemented in a transmittable carrier wave in which the control program is embodied as a data signal using transmission media, such as acoustic or light waves, such as those generated during radio wave and infrared data communications, and the like.

The memory 54 stores registration data 56 received from the registration subsystem (e.g., from one or more sensors that detect sheet position, arrival, departure, and the like at one or more registration points), and compared to expected registration data 57. In one embodiment, the measured registration data includes an arrival time (e.g., a time stamp or the like included in a digital signal generated upon application of an image to the sheet upon the arrival of the sheet) for each sheet at a specified point on the paper path (e.g., as a leading edge of the sheet begins to have an image applied to it as it passes a roller nip along the paper path, etc.). Arrival time for each sheet, or average arrival time for several sheets is compared to an expected arrival time value for the sheet(s) at the given registration point, to calculate a a registration error.

The memory 54 stores one or more error calculation algorithms 58 that, when executed by the processor 53, perform the above-described comparison(s) and determine an error value. The processor 53 executes a correction factor algorithm that generates a correction factor or value that is added to the expected time value to correct for the delay and improve marking quality on the sheets. In another embodiment, the correction factor is generated using a correction factor LUT 60 (e.g., the processor looks up a correction factor given the determined error value). One or more control algorithms 62 are then executed to adjust photoreceptor and/or roller operation metrics according to the corrected registration times.

The adaptive control algorithm(s) 62 are thus applied to paper scheduling to adapt to paper path timing error and variation. Process registration error as measured at registration input is employed as feedback to the scheduler for improved registration. In this manner, registration performance is improved by reducing the amount of process correction required by the registration subsystem 51. For instance, the registration subsystem 51 can steer the sheet for lateral and skew correction using known techniques, since process direction error has been corrected by the control algorithm(s).

Additionally, the system can correct for timing error accumulation (e.g., cumulative or additive error across multiple pages or printing jobs) with multiple feeder configurations and 3$^{rd}$ party feeding. Correction can be done real time during printing, and does not need a diagnostic routine setup.

Figure 3:
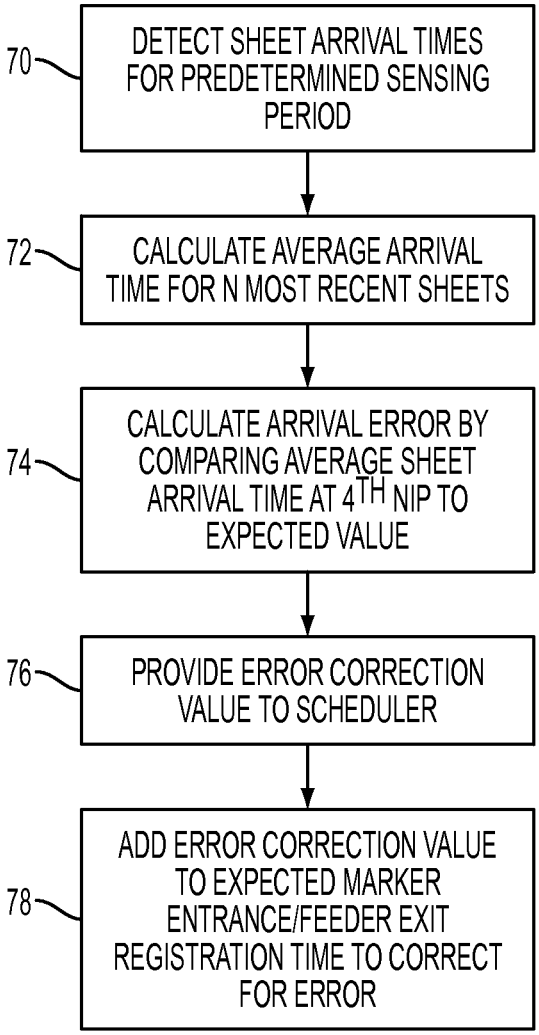
FIG. 3 illustrates a method for correcting for registration errors in a marker module of a print engine with a simplex feeder arrangement, in accordance with various aspects described herein.

FIG. 3 illustrates a method for correcting for registration errors in a marker module of a print engine with a simplex feeder arrangement, in accordance with various aspects described herein. At 70, sheet arrival time is sensed. In one example, sheet arrival times are sensed for several sheets over a predetermined time period (e.g., several seconds or the like) to determine a running average of sheet arrival times. Arrival time may be determined when a leading edge of each sheet 13 passes a registration point (e.g., the sensor 30 adjacent key roller 26) and causes a digital signal to be generated when the key roller 26 begins to apply an image to the leading edge of an image for the sheet 13. At 72, an average arrival time of one or more sheets is compared to a reference or expected arrival time (e.g., calculated using the sheet entrance registration time, sheet speed, and distance traveled). The average arrival time may be a running average (e.g., for a most recent N sheets, where N is an integer, such as 10).

At 74, sheet arrival error is determined or calculated by comparing sheet arrival time (e.g., for an individual sheet or for a running average of several sheets) to the expected arrival time at the registration point. In one example, sheet arrival time is measured as the marker module begins applying key or black toner to a leading edge of the sheet(s). In the example described with regard to FIG. 1, the sheet arrival time is determined or calculated at a known point in the paper path while the image is being written with the black imager 26.

At 76, a scheduling correction value is generated or looked up in a lookup table to correct for any detected registration error, and fed back to the scheduler. At 78, the scheduler adds the positive or negative correction value or factor to the expected or reference registration time value for the marker entrance/feeder exit registration point (e.g., point 34 in FIG. 1) to compensate for the detected error. In this manner, the marker module is adjusted in real-time using a running average of sheet registration times to ensure proper marking regardless of the magnitude of the registration error.

Figure 4:
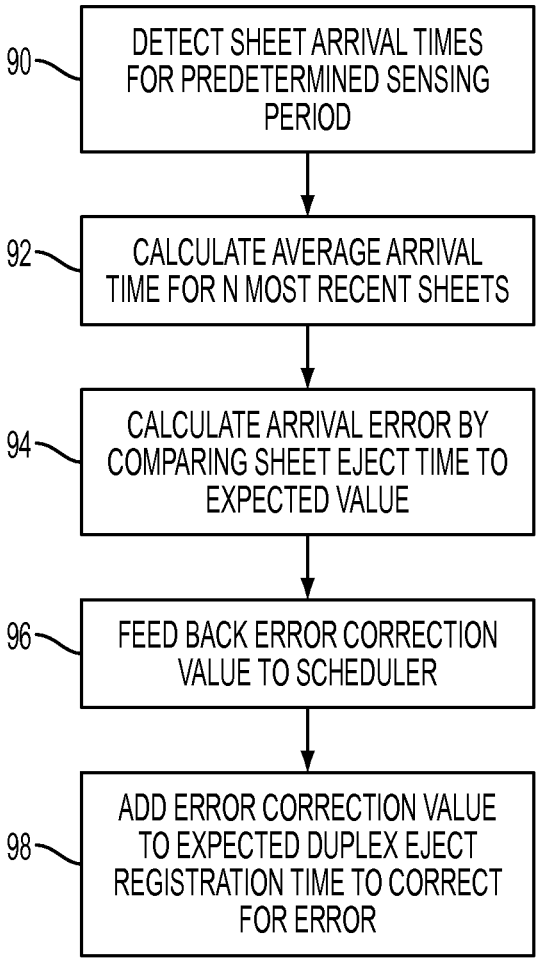
FIG. 4 illustrates a method for correcting for registration errors in a marker module of a print engine with a duplex feeder arrangement, in accordance with various aspects described herein.

FIG. 4 illustrates a method for correcting for registration errors in a marker module of a print engine with a duplex feeder arrangement, in accordance with various aspects described herein. At 90, sheet arrival time is determined. In one example, sheet arrival times are determined for several sheets over a predetermined time period (e.g., several seconds or the like) to determine a running average of sheet arrival times. Arrival time may be determined from a digital signal that is generated when a leading edge of each sheet 13 passes the registration point (e.g., at a known location, e.g., at the sensor 30 adjacent the black roller 26, while the sheet image arrives at the nip of black roller 26 of FIG. 1). At 92, an average arrival time of one or more sheets arriving at the registration point (sensor 30) is compared to a reference or expected arrival time. At 94, sheet arrival error is determined or calculated by comparing sheet arrival time (e.g., for an individual sheet or for a running average of several sheets, such as a most recent 10 sheets that have arrived) to the expected arrival time. In one example, sheet arrival time is measured as the marker module begins applying key or black toner to a leading edge of an image on the photoreceptor for transfer to the sheet(s). In the example described with regard to FIG. 1, this arrival time of the sheet(s) at the nip of the image transfer roller located at the image transfer position 36 would be calculated.

At 96, a scheduling correction value or factor is generated or looked up in a lookup table to correct for any detected registration error, and fed back to the scheduler. At 98, the scheduler adds the positive or negative correction value or factor to the expected or reference registration time for the duplex eject registration point (e.g., where duplex-printed sheets are ejected from the marker module, at point 36 in FIG. 1) to compensate for the detected error. In this manner, the marker module is adjusted in real-time using a running average of sheet registration times to ensure proper marking regardless of the magnitude of the registration error.

The methods illustrated in FIGS. 3 and 4 may be implemented in a computer program product that may be executed on a computer or computing device in the marker module of FIGS. 1 and 2. Further, it is to be appreciated that any suitable computing environment can be employed in accordance with the present embodiments. For example, computing architectures including, but not limited to, stand alone, multiprocessor, distributed, client/server, minicomputer, mainframe, supercomputer, digital and analog can be employed in accordance with the present embodiments.

The computer can include a processing unit such as the processor 53 of FIG. 2, a system memory such as the memory 54 of FIG. 2, and a system bus that couples various system components including the system memory to the processing unit. The processing unit can be any of various commercially available processors (e.g., a central processing unit, a graphical processing unit, etc.). Dual microprocessors and other multi-processor architectures also can be used as the processing unit.

The system bus can be any of several types of bus structure including a memory bus or memory controller, a peripheral bus, and a local bus using any of a variety of commercially available bus architectures. The computer memory includes read only memory (ROM) and random access memory (RAM). A basic input/output system (BIOS), containing the basic routines that help to transfer information between elements within the computer, such as during start-up, is stored in ROM.

The computer can further include a hard disk drive, a magnetic disk drive, e.g., to read from or write to a removable disk, and an optical disk drive, e.g., for reading a CD-ROM disk or to read from or write to other optical media. The computer typically includes at least some form of computer readable media. Computer readable media can be any available media that can be accessed by the computer. By way of example, and not limitation, computer readable media may comprise computer storage media and communication media. Computer storage media includes volatile and non-volatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other magnetic storage devices, or any other medium which can be used to store the desired information and which can be accessed by the computer.

Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above can also be included within the scope of computer readable media.

A number of program modules may be stored in the drives and RAM, including an operating system, one or more application programs, other program modules, and program non-interrupt data. The operating system in the computer can be any of a number of commercially available operating systems.

A user may enter commands and information into the computer through a keyboard (not shown) and a pointing device or stylus (not shown), such as a mouse. Other input devices (not shown) may include a microphone, an IR remote control, a joystick, a game pad, a satellite dish, a scanner, or the like.

These and other input devices are often connected to the processing unit through a serial port interface (not shown) that is coupled to the system bus, but may be connected by other interfaces, such as a parallel port, a game port, a universal serial bus (USB), an IR interface, etc.

A monitor (not shown), or other type of display device, may also be connected to the system bus via an interface, such as a video adapter (not shown). In addition to the monitor, a computer typically includes other peripheral output devices (not shown), such as speakers, printers etc. The monitor can be employed with the computer to present data that is electronically received from one or more disparate sources. For example, the monitor can be an LCD, plasma, CRT, etc. type that presents data electronically. Alternatively or in addition, the monitor can display received data in a hard copy format such as a printer, facsimile, plotter etc. The monitor can present data in any color and can receive data from the computer via any wireless or hard wire protocol and/or standard.

The computer can operate in a networked environment using logical and/or physical connections to one or more remote computers, such as a remote computer(s). The remote computer(s) can be a workstation, a server computer, a router, a personal computer, microprocessor based entertainment appliance, a peer device or other common network node, and typically includes many or all of the elements described relative to the computer. The logical connections depicted include a local area network (LAN) and a wide area network (WAN). Such networking environments are commonplace in offices, enterprise-wide computer networks, intranets and the Internet.

When used in a LAN networking environment, the computer is connected to the local network through a network interface or adapter. When used in a WAN networking environment, the computer typically includes a modem, or is connected to a communications server on the LAN, or has other means for establishing communications over the WAN, such as the Internet. In a networked environment, program modules depicted relative to the computer, or portions thereof, may be stored in the remote memory storage device. It will be appreciated that network connections described herein are exemplary and other means of establishing a communications link between the computers may be used.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method of correcting for paper process direction arrival errors during a print job in a print engine, comprising:

determining paper sheet arrival times at a first registration point in the print engine over a predetermined time period;

calculating a running average of the determined arrival times for most recent N sheets, where N is an integer, wherein the calculation of the running average is performed continuously for the duration of the print job;

comparing the average arrival time to an expected sheet arrival time for the first registration point;

determining a registration correction factor as a function of a difference between the average arrival time to an expected sheet arrival time for the first registration point;

adding the correction factor to an expected arrival time for a second registration point to generate an updated expected arrival time value for the second registration point; and adjusting control parameters of a marking module in the print engine according to the updated expected arrival time value.

2. The method of claim 1, further comprising:

determining the registration correction factor by subtracting the expected sheet arrival time for the first registration point from the average arrival time.

3. The method of claim 1, further comprising:

determining the registration correction factor by looking up the registration correction factor in a lookup table as a function of the average arrival time.

4. The method of claim 1, wherein the print job is a simplex print job.

5. The method of claim 4, wherein the second registration point is located on a paper path through the print engine, between entrance to a marker module and the exit of a feeder that feeds paper sheets into the marker module.

6. The method of claim 1, wherein the print job is a duplex print job.

7. The method of claim 6, wherein the second registration point is located on a paper path through the print engine where the paper sheets are ejected from a marker module.

8. The method of claim 1, wherein the first registration point is positioned near a roller in a marker module, and wherein the sheet arrival time information for each sheet is retrieved from a digital signal that is generated when the roller begins to apply an image to be transferred to a leading edge of the paper sheets as they pass by the roller.

9. A system that facilitates correcting for paper process direction arrival errors during a print job, comprising:

a marker module that generates printed paper sheets;

a registration subsystem comprising a plurality of sensors that detect and register sheets at one or more points along a paper path; and a scheduler that controls the marking module to apply toner to the sheets, the scheduler comprising:

a processor that:

receives sheet arrival time information for sheets arriving at a first registration point on the paper path over a predetermined time period;

calculates a running average of the sheet arrival times for most recent N sheets, where N is an integer, wherein the calculation of the running average is performed continuously for the duration of the print job;

compares the running average arrival time to an expected sheet arrival time for the first registration point;

determines a registration correction factor as a function of a difference between the running average arrival time and an expected sheet arrival time for the first registration point;

adds the correction factor to an expected arrival time for a second registration point to generate an updated expected arrival time value for the second registration point; and adjusts control parameters of a marking module in the print engine according to the updated expected arrival time value.

10. The system of claim 9, further comprising a computer-readable medium that stores sheet arrival times, running average of the arrival times, expected sheet arrival times, registration correction factors, updated expected arrival time values, and control parameters.

11. The system of claim 9, wherein the processor determines the registration correction factor by subtracting the expected sheet arrival time for the first registration point from the running average arrival time.

12. The system of claim 9, wherein the processor determines the registration correction factor by looking up the registration correction factor in a lookup table stored in a memory, as a function of the running average arrival time.

13. The system of claim 9, wherein the print job is a simplex print job.

14. The system of claim 13, wherein the second registration point is located on a paper path through the print engine, between entrance to the marker module and the exit of a feeder that feeds paper sheets into the marker module.

15. The system of claim 9, wherein the print job is a duplex print job.

16. The system of claim 15, wherein the second registration point is located on a paper path through the print engine where the paper sheets are ejected from the marker module.

17. The system of claim 9, wherein the first registration point is positioned near a roller in the marker module, and wherein the sheet arrival time information for each sheet is retrieved from a digital signal that is generated when the roller begins to apply an image to be transferred to a leading edge of the paper sheets as they pass by the roller.

18. A method of correcting for paper process direction arrival errors during a print job in a marker module of a print engine, comprising:

determining a running average arrival time for most recent N sheets, where N is an integer, at a first registration point on a paper path traversed by the sheets, wherein the determination of the running average is performed continuously for the duration of the print job;

determining a registration error value by comparing the running average arrival time to an expected arrival time at the first registration point;

determining a correction factor for the registration error;

adding the correction factor to an expected arrival time at a second registration point on the paper path to generate a corrected expected arrival time at the second registration point; and adjusting control of the marker module according to the corrected expected arrival time.

19. The method of claim 18, wherein:

the print job is a simplex print job;

the first registration point is positioned near a roller in the marker module, and wherein the sheet arrival time information for each sheet is retrieved from a digital signal that is generated when the roller begins to apply an image to a leading edge of the paper sheets as they pass by the roller; and the second registration point is located on a paper path through the print engine, between entrance to the marker module and the exit of a feeder that feeds paper sheets into the marker module.

20. The method of claim 18, wherein:

the print job is a duplex print job;

the first registration point is positioned near a roller in the marker module, and the first registration point wherein the sheet arrival time information for each sheet is retrieved from a digital signal that is generated when the roller begins to apply an image to a leading edge of the paper sheets as they pass by the roller; and wherein the second registration point is located on a paper path through the print engine where the paper sheets are ejected from the marker module.

* * * * *